US006206083B1

(12) United States Patent
Schwerdtfeger et al.

(10) Patent No.: US 6,206,083 B1
(45) Date of Patent: Mar. 27, 2001

(54) STRIP CASTING DEVICE

(75) Inventors: Klaus Schwerdtfeger, Goslar; Karl-Heinz Spitzer, Clausthal-Zellerfeld; Wolfgang Reichelt; Ulrich Urlau, both of Moers; Joachim Kroos, Meine; Heino Buddenberg, Wolfen, all of (DE)

(73) Assignee: Mannesmann AG, Düsseldorf (DE)

( * ) Notice: Subject to any disclaimer, the term of this patent is extended or adjusted under 35 U.S.C. 154(b) by 0 days.

(21) Appl. No.: 09/194,820

(22) PCT Filed: Jun. 5, 1997

(86) PCT No.: PCT/DE97/01178

§ 371 Date: Jan. 26, 1999

§ 102(e) Date: Jan. 26, 1999

(87) PCT Pub. No.: WO97/47414

PCT Pub. Date: Dec. 18, 1997

(30) Foreign Application Priority Data

Jun. 7, 1996 (DE) ..... 196 22 927
Sep. 10, 1996 (DE) ..... 196 36 696

(51) Int. Cl.[7] ..... B22D 11/06

(52) U.S. Cl. ..... 164/429; 164/435; 164/253; 164/432

(58) Field of Search ..... 164/429, 435, 164/253, 432

(56) References Cited

U.S. PATENT DOCUMENTS 5,740,852 * 4/1998 Feuerstacke et al. ..... 164/429

FOREIGN PATENT DOCUMENTS 63-192539 * 8/1988 (JP) ..... 164/429
63-286247 * 11/1988 (JP) ..... 164/432
63-286249 * 11/1988 (JP) ..... 164/432
4-300053 * 10/1992 (JP) ..... 164/429

OTHER PUBLICATIONS

K.H. Spitzer et al "Production of Steel Strip, with a Single Belt Process" in Iron and Steel Makers, vol. 22, No. 11, Nov. 1995, pp. 47–53.*

* cited by examiner

*Primary Examiner*—Harold Pyon
*Assistant Examiner*—I. -H. Lin
(74) *Attorney, Agent, or Firm*—Cohen, Pontani, Lieberman & Pavane

(57) ABSTRACT

A strip casting plant with a circulating belt. In the cooling area, the belt is sucked against carriers by a negative pressure in the cooler. The carriers are arranged so that, with given mechanical properties of the circulating belt, a deflection that compensates for the thermal elongation takes place between the supporting surfaces of the carriers.

2 Claims, 2 Drawing Sheets

STRIP CASTING DEVICE

BACKGROUND OF THE INVENTION

1. Field of the Invention

The invention relates to a strip casting device.

2. Discussion of the Prior Art

A strip casting device refers here to a plant in which the liquid steel is transported via a feeding system to a circulating belt which is cooled from below by water. The underside of the applied layer of steel then solidifies in contact with the belt and the upper side solidifies as a free surface under inert gas or, to achieve better surface properties, in contact with an upper roller. After solidifying completely, the strand (strip) produced leaves the circulating transport belt and is transported further by a driver. The casting thickness of the strip (about 10 mm) can be chosen largely optimally for the required thickness of the finish-rolled hot strip (1 to 3 mm) and the required hot deformation for achieving adequate material properties. The optimum casting thickness is in this case the thickness at which the required degree of hot deformation is achieved with as little deformation work as possible.

The circulating transport belt makes it possible for the strand to be cooled and supported largely without friction over a long distance. This results in a high casting rate, which is a prerequisite for a direct coupling between the casting plant and the rolling stage, and high productivity as a basic condition for the casting of ordinary steels.

The circulating belt, accessible from above and the front, makes it easier for the steel to be fed in. Unlike in other processes, the steel does not have to be guided into a narrow gap between two belts or rolls.

In the area between the conveying rollers for the circulating belt, a cooling device (water cooling with suitable nozzles) is arranged on the side of the circulating belt facing away from the steel, for cooling said belt. In spite of this cooling, the high temperatures applied to the upper side of the belt by the steel melt cause the circulating belt to curve upward. This upward curvature results in the strand also being shaped in its upper surface. To avoid the upward curvature, a negative pressure is set in the cooler. The difference in pressure causes the circulating belt to be pressed onto supporting rollers, for example.

Supporting rollers used in the past (See Production of steel strip with a single-belt process, K. -H. Spitzer and K. Schwerdtfeger, ISM November 1995, page 51) exhibited a longitudinal section with grooves which (FIG. 12 of the publication) had supporting rollers, that is to say a profiled surface, the profile having in longitudinal section portions of larger diameter than the minimum roller diameter. The width of these spacings corresponded in the past substantially to the distance between the portions.

In the case of such roller designs or any other carriers on which the spacing of the supporting surfaces of the circulating belt substantially corresponded to the width of the latter, it was not possible for the particularly thermally induced stresses in the circulating transport belt to be reduced in a controlled manner. As soon as the stability limit is exceeded by excessive stresses, the circulating belt curves up with a particular tendency in the central area. The negative pressure which has been set thus does not lead to the desired result in the case of the roller design used in the past, since the upward curvature of the circulating belt continues to influence the shape of the strand in an undesired way.

SUMMARY OF THE INVENTION

The object of the invention is to provide a strip casting device in which the maximum deviation of the transport belt from the surface area defined by the carriers is minimized. The upward curvature is thus to be reduced.

Pursuant to this object, and others which will become apparent hereafter, one aspect of the present invention resides in a strip casting device having melt feeding means, a circulating belt for cooling a cast melt, and carriers for supporting the circulating belt. A negative pressure acts on a side of the belt facing the carriers. The carriers have support surfaces that are spaced so that, with given mechanical properties of the circulating belt, a bending that compensates for thermal elongation takes place between the support surfaces.

According to the invention, in a strip casting plant with melt feeding and a circulating transport belt which is pressed against carriers by negative pressure, the carriers are arranged at such spacings that, with given mechanical properties of the circulating belt and known mechanical and thermal loading, a deflection (upward curvature) that compensates for the thermal elongation takes place between a plurality of supporting surfaces. In this case, the upward curvature is divided into a plurality of smaller curvatures.

The carriers preferably have supporting surfaces which are not continuous, and the spacing of the carriers or the supporting surfaces is, in particular, greater than the length of the supporting surface, measured in the direction in which the spacing is measured. The optimum spacing of the supporting surfaces can be determined in connection with the negative pressure and the known mechanical and thermal loading as well as the given boundary conditions and known mechanical properties of the circulating belt. The spacing of the supporting surfaces of adjacent carriers is preferably at least twice as great as the length of a supporting surface, measured in the direction of the spacing.

Any desired devices may be used as carriers. A preferred form which the carriers may take is that of supporting rollers which are provided with a profiled surface. This surface has in longitudinal section portions of larger diameter than the minimum roller diameter, the width of the portions being smaller than the spacing of the portions in the longitudinal direction of the roller. Expressed conversely, this means that between the portions of larger diameter there is a distance which is a multiple of the width of the portions carrying the circulating belt, measured in the longitudinal direction of the supporting rollers. This achieves the effect that the circulating belt no longer curves upward but is drawn into the area between the portions of larger diameter by the difference in pressure. As a result, the upward curvature of the belt is reduced, or a plurality of small upward curvatures occur over the width and length of the circulating belt instead of one large upward curvature.

According to a preferred embodiment, the spacing of the portions of larger diameter is at least twice the width of the portions, measured in the longitudinal direction of the roller. This ensures that a sufficiently large surface area is set between the supporting points of the circulating belt on the portions of larger diameter, so that a controlled reduction of the stresses in the longitudinal direction of the roller is made possible.

According to a further embodiment, the portions of larger roller diameter have in longitudinal section of the roller a substantially rectangular shape. The portions are then to be regarded essentially as disks, the thickness of which corresponds to the width of the portions, measured in the longitudinal direction of the roller. This shape contributes to better support of the belt and offers an increased supporting surface in comparison with tapering shapes.

According to another embodiment, the substantially rectangular shape of the portions is of a trapezoidal design on the narrow sides. The portions of larger diameter, previously referred to as rings, thus have angled-off or rounded-off edges in the region of the corners. Consequently, the circulating belt can to a greater extent follow the pressure directed toward the roller axis without the previously described advantage of the increased supporting surface and better supporting effect.

According to a further embodiment, the portions of larger diameter form an angle with the roller axis which is less than 90 degrees. The portions previously referred to as disks are thus not perpendicular to the axis of the supporting roller in this configuration but are arranged obliquely with respect to it. The supporting surface is further enlarged as a result. In particular, the portions of larger diameter may also run helically around the axis of the supporting roller, allowing transverse forces to be derived in an improved way.

The arrangement according to the invention envisages for one of the carriers or supporting rollers described above that the supporting surfaces of a roller or series of carriers are arranged offset with respect to the supporting surfaces of the adjacent roller or series of carriers. This avoids the formation of channel-shaped depressions in the circulating belt, which could otherwise be imprinted in the surface of the steel strip.

According to yet a further embodiment, the supporting surfaces are offset with respect to one another in such a way that the supporting surfaces for a roller or series of carriers are arranged substantially mid-way between the supporting surfaces for the adjacent roller or series of carriers.

In still a further embodiment, in the case of supporting rollers, the portions of larger diameter of adjacent supporting rollers are arranged at an angle with respect to one another. In this configuration, the "disks" of adjacent supporting rollers are not only oblique to the respective roller axis but also oblique to one another in the manner of a herringbone pattern. The carriers may also be designed and arranged correspondingly.

Insofar as the portions of larger diameter have been referred to as disks, this does not constitute a restriction of the extent of protection but only an illustration. The portions of larger diameter may also be designed in such a way that their width is greater than their diameter. The portions of larger diameter then tend to assume the shape of a short piece of tube. In particular, the carriers may also be configured as individual rollers or skids.

BRIEF DESCRIPTION OF THE DRAWINGS

An exemplary embodiment is schematically represented in the drawings, in which.

DETAILED DESCRIPTION OF THE PREFERRED EMBODIMENTS

Figure 1:
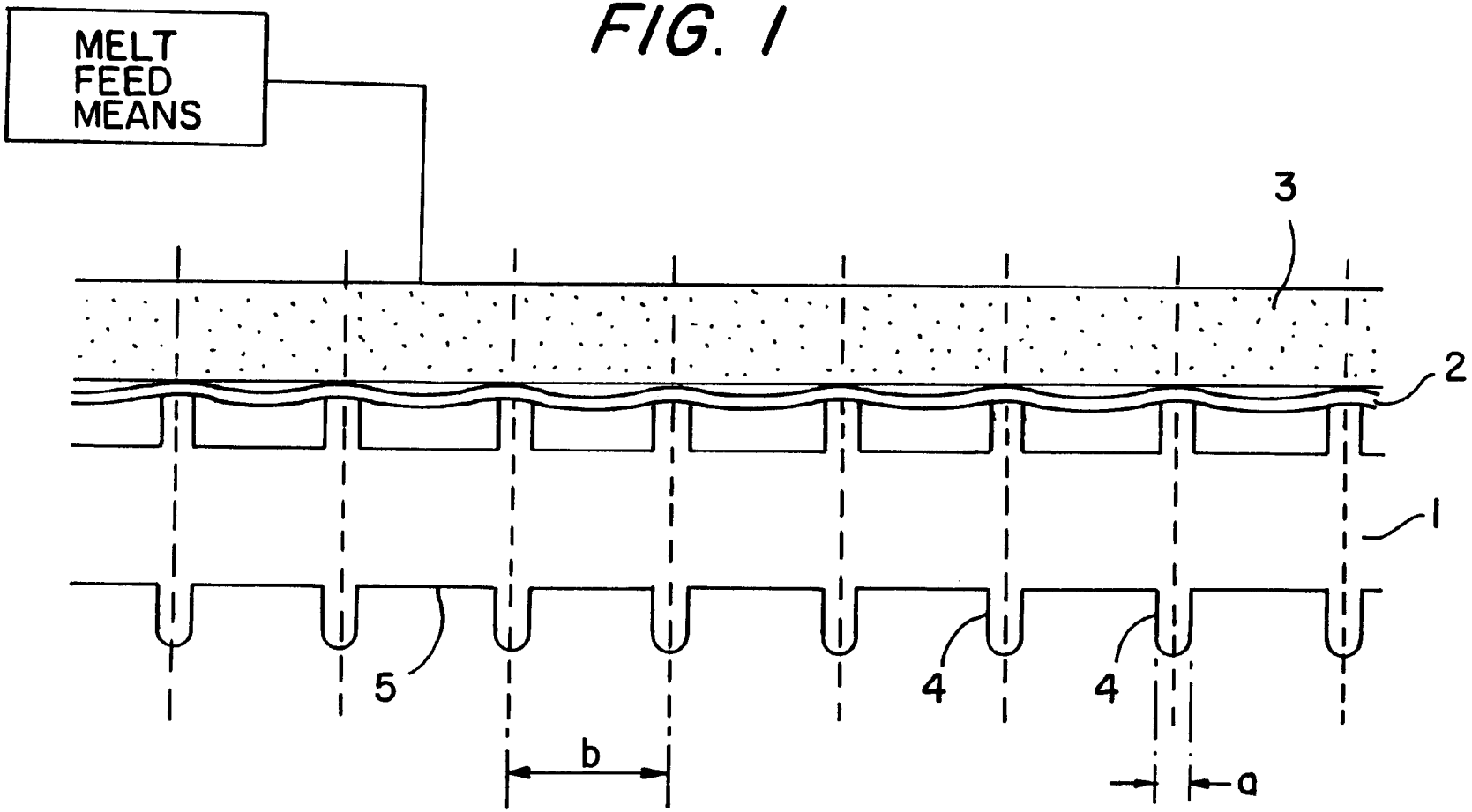
FIG. 1 shows a longitudinal section through a supporting roller.

In FIG. 1, a supporting roller 1 is represented in longitudinal section. The supporting roller 1 extends transversely over the width of the circulating belt 2, that is to say also transversely with respect to the transporting direction of the thin cast strip 3. The supporting roller 1 has portions 4 of increased diameter in comparison with the minimum roller diameter 5. The width a of the portions 4 is smaller than the spacing b of the portions 4.

Figure 2:
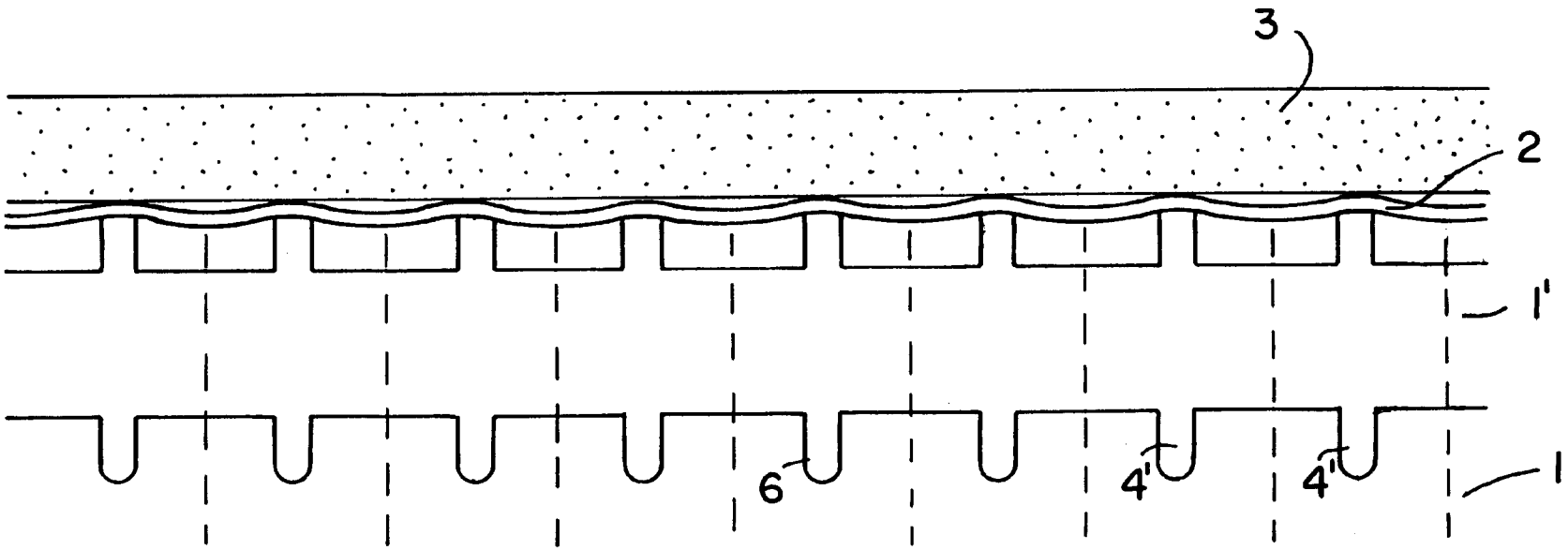
FIG. 2 shows a longitudinal section through a supporting roller adjacent to that represented in FIG. 1.

In FIG. 2, the roller 1' adjacent in the travel direction of the belt 2, to the roller 1 from FIG. 1 is represented. The trace of the portions 4 shown in FIG. 1 is drawn as a broken line (in FIG. 1) and transferred onto FIG. 2 as a broken line. The trace of the portions 4 of the roller 1 thus lies mid-way between the portions 4' of the roller 1'. The portions 4 or 4' in the longitudinal section shown are of a substantially rectangular shape. They preferably have angled-off or rounded-off bevels 6 on their narrow sides, so that a substantially trapezoidal section is produced there. Between the portions 4 (4') of the respective rollers, the circulating belt 2 is curved toward the roller axis. This relatively small curvature is not imprinted onto the thin cast strip 3 in first approximation, or is negligible in comparison with the upward curvature otherwise extending over virtually the entire length of the rollers.

What is claimed is:

1. A strip casting device, comprising:

a circulating, water-cooled belt for cooling a cast melt;

melt feed means for feeding the melt to the belt; and carriers for supporting the circulating belt, a negative pressure being actuable on a side of the belt facing the carriers, wherein each of the carriers comprising supporting surfaces of uniform diameter and spacings between each two supporting surfaces, wherein the supporting surfaces are spaced at a distance greater than a length of the supporting surfaces and the spacings are of a smaller diameter than the supporting surfaces, so that a bending of the belt that compensates for thermal elongation takes place between the supporting surfaces.

2. A strip casting device as defined in claim 1, wherein the supporting surfaces are spaced at a distance at least twice as great as the length of the supporting surfaces.

* * * * *